US009061778B2

(12) United States Patent
Downhill

(10) Patent No.: US 9,061,778 B2
(45) Date of Patent: Jun. 23, 2015

(54) PACKAGING METHOD AND APPARATUS

(75) Inventor: Graham Downhill, Lancashire (GB)

(73) Assignee: Oakbridge Investments Limited, Huddersfield (GB)

( * ) Notice: Subject to any disclaimer, the term of this patent is extended or adjusted under 35 U.S.C. 154(b) by 697 days.

(21) Appl. No.: 13/382,883

(22) PCT Filed: Jul. 8, 2010

(86) PCT No.: PCT/GB2010/001307

§ 371 (c)(1),
(2), (4) Date: Jan. 6, 2012

(87) PCT Pub. No.: WO2011/004157

PCT Pub. Date: Jan. 13, 2011

(65) Prior Publication Data

US 2012/0102888 A1 May 3, 2012

(30) Foreign Application Priority Data

Jul. 10, 2009 (GB) ..... 0911999.1
Jan. 11, 2010 (GB) ..... 1000330.9

(51) Int. Cl.
*B65B 13/04* (2006.01)
*B65B 11/00* (2006.01)
*B65B 11/58* (2006.01)

(52) U.S. Cl.
CPC ..... *B65B 11/008* (2013.01); *B65B 11/58* (2013.01)

(58) Field of Classification Search
CPC .. B65B 11/008; B65B 11/025; B65B 21/245; B65B 11/006
USPC ..... 53/167, 210, 461, 466, 586, 591, 153, 53/531, 556, 176, 580, 581, 582, 588, 589, 53/203, 218, 389.1, 389.4, 389.5
See application file for complete search history.

(56) References Cited

U.S. PATENT DOCUMENTS 4,553,374 A 11/1985 Lancaster et al.
4,593,518 A * 6/1986 Lancaster ..... 53/556

(Continued)

FOREIGN PATENT DOCUMENTS

DE 3341897 9/1984
EP 0595580 5/1994

(Continued)

OTHER PUBLICATIONS

Search Report from the United Kingdom Intellectual Property Office for Application No. 0911999.1 dated Oct. 20, 2009 (2 pages).

*Primary Examiner* — Stephen F Gerrity
*Assistant Examiner* — Eyamindae Jallow
(74) *Attorney, Agent, or Firm* — Michael Best & Friedrich LLP

(57) ABSTRACT

A packaging apparatus includes a wrapping material applicator for helically wrapping together a collation of articles, a first conveyor for transporting unwrapped collations of articles to the applicator; a second conveyor for transporting wrapped collations of articles away from the applicator; a base band applicator upstream of the wrapping material applicator for providing a base band of wrapping material underneath the unwrapped collations of articles such that the base band extends between wrapped collations of articles downstream of the applicator and unwrapped collations of articles upstream of the applicator, the base band being wrapped together with the collations of articles; and a tensioning mechanism configured, in use, to place at least a portion of the base band under tension before an unwrapped collation of articles is placed onto that portion of the base band. The first and second conveyors are spaced apart and the applicator is provided between them.

32 Claims, 3 Drawing Sheets

(56) References Cited

U.S. PATENT DOCUMENTS

| | | | | |
|---|---|---|---|---|
| 4,730,436 | A * | 3/1988 | Angelino | 53/170 |
| 4,979,358 | A * | 12/1990 | Keip | 53/556 |
| 5,182,894 | A * | 2/1993 | Bate | 53/399 |
| 5,423,161 | A * | 6/1995 | Huson et al. | 53/449 |
| 5,433,058 | A * | 7/1995 | Peterson | 53/399 |
| 5,505,042 | A * | 4/1996 | Keip | 53/588 |
| 5,522,207 | A * | 6/1996 | Keip | 53/556 |
| 5,531,061 | A * | 7/1996 | Peterson | 53/526 |
| 5,577,366 | A * | 11/1996 | Higgins | 53/399 |
| 5,966,904 | A * | 10/1999 | Peters | 53/399 |
| 6,289,652 | B1 | 9/2001 | Lancaster, III et al. | |
| 6,347,500 | B1 * | 2/2002 | Peeters et al. | 53/588 |
| 6,745,544 | B2 * | 6/2004 | Matsumoto et al. | 53/399 |
| 6,751,931 | B2 * | 6/2004 | Cere' | 53/397 |
| 7,536,844 | B2 | 5/2009 | Aubin et al. | |
| 7,661,244 | B2 * | 2/2010 | Downhill | 53/176 |
| 7,797,913 | B2 * | 9/2010 | Gorrieri et al. | 53/466 |
| 2002/0029540 | A1 * | 3/2002 | Lancaster et al. | 53/399 |
| 2003/0110737 | A1 * | 6/2003 | Lancaster et al. | 53/441 |

FOREIGN PATENT DOCUMENTS

| | | |
|---|---|---|
| EP | 1447332 | 8/2004 |
| GB | 2076772 | 12/1981 |
| GB | 2267692 | 12/1993 |
| WO | 9009316 A1 | 8/1990 |
| WO | 2006051281 A1 | 5/2006 |

* cited by examiner

PACKAGING METHOD AND APPARATUS

CROSS REFERENCE TO RELATED APPLICATIONS

This application is a national phase application of PCT Application No. PCT/GB2010/001307, filed Jul. 8, 2010, which claims priority to United Kingdom Patent Application No. 1000330.9, filed Jan. 11, 2010 and United Kingdom Patent Application No. 09011999.1, filed Jul. 10, 2009, the entire contents of which are both hereby incorporated by reference therein.

BACKGROUND

The present invention relates to a method and apparatus for packaging collations of articles and more particularly, but not exclusively, to a method and apparatus for packaging together collations of articles in a production line environment.

It is known to package articles by wrapping them in flexible sheet material such as, for example, highly stretched synthetic plastics film. An article, or a group of articles, is typically enclosed between two sheets of material or a folded single sheet and the material is heat sealed at overlapping edges.

A continuous process for wrapping articles in material of this kind is described in international patent application WO 90/09316 which discloses a longitudinal wrapping machine whereby articles are wrapped by winding a continuous web of wrapping material around the articles in a direction generally transverse to their direction of movement along the machine. This results in the articles being wrapped by a helical continuous web of material. The machine has an upstream conveyor that is separated from a downstream conveyor by a rotary ring-type web applicator whose rotary axis is generally parallel to the longitudinal axis of the conveyors. The articles are fed to the applicator by the upstream conveyor and as they pass through the ring of the applicator at a predetermined speed it rotates and dispenses the wrapping material. As a result, the articles are wrapped by a continuous helical band of material. The wrapped articles pass to the downstream conveyor which carries them to a cutting station, which separates the wrapped articles into individually wrapped articles by cutting through the adjoining wrapping between each article. A longitudinal web of material disposed on the conveyors passes through the applicator and is transported under the articles at the same rate. This web serves to bridge the gap between the upstream and downstream conveyors and the applicator and thus supports the articles as they pass continuously between them.

In some instances, a fixed bracket is provided which extends through the applicator ring substantially from the end of the upstream conveyor to the beginning of the downstream conveyor. The bracket serves to support the material bearing the articles as they are wrapped by the applicator ring. However, where articles are smaller than the distance between the upstream and downstream conveyor, the packs of articles tend to sit on the dead plate until they are pushed onto the downstream conveyor by following articles. This is problematic at the cutting stage because the articles are too close together on the downstream conveyor for the cutting station to be able to operate effectively.

Collations of articles are usually secured together (for example on cardboard pallets and/or wrapped together by packaging tape) before wrapping. However, it may be desirable to wrap collations of articles together which are not secured together before they are wrapped, i.e. "unsecured collations". The wrapping material therefore serves both to protect the articles for shipping and to hold the articles together in collations. Wrapping collations of articles in this way means that no extra material is required to secure the articles together, which provides significant advantages in cost and efficiency during packaging and shipping. However, the lack of any securement allows the articles to move relative to one another during the wrapping process with the result that the wrapped articles may not be wrapped tightly together. In some cases, such as when the articles have a high centre of gravity, unsecured articles may even fall over before wrapping has occurred, causing costly stoppages in a production line environment.

SUMMARY

Accordingly, it is an object of the present invention to obviate or mitigate at least some of the problems which are apparent from the above.

According to a first aspect of the present invention there is provided packaging apparatus comprising: a wrapping material applicator for helically wrapping together a collation of articles; a first conveyor for transporting unwrapped collations of articles towards the applicator; a second conveyor for transporting wrapped collations of articles away from the applicator; and a base band applicator upstream of the wrapping material applicator for providing a base band of wrapping material underneath the unwrapped collations of articles such that the base band extends between wrapped collations of articles downstream of the applicator and unwrapped collations of articles upstream of the applicator, the base band being wrapped together with the collations of articles; wherein the first and second conveyors are spaced apart and the applicator is provided between them, and the packaging apparatus further comprises an intermediate support conveyor between the first and second conveyors configured, in use, to support the base band within the applicator as the collations of articles are transported from the first conveyor towards the second conveyor.

Providing an intermediate support conveyor to support the base band within the applicator is advantageous in that stretching of the base band as it draws the articles through the applicator is avoided; thus articles in a collation cannot easily move apart whilst being wrapped, resulting in a tighter and more efficient wrapping of the collation. The intermediate support conveyor may be configured such that no significant resistance is offered to the transit of articles from the first conveyor towards the second conveyor.

The support conveyor may have a surface for contact with the base band having a lower coefficient of friction than a corresponding surface of either the first or second conveyor. That is, for a given support surface area on the support conveyor, the frictional force applied by the support surface on the base band is less than the frictional force applied by an equal surface area of either one of the first and second conveyors. The lower coefficient of friction may be achieved by one or more of the selection of the material of which the surface is comprised, the texture of the surface, or a substance applied as a friction reduction coating to the surface. Advantageously, a low friction coating reduces friction between the lower band and the support conveyor, thus reducing the likelihood of stretching The surface may translate so as to convey the articles and the support conveyor may be in the form of a circulating endless loop that defines said conveying surface.

The conveyor may be configured to run at least as fast as the speed of transit of the base band through the applicator. This movement of the support conveyor reduces drag (i.e. frictional stretching forces) on the lower band. In particular, where the support conveyor is configured to run at a faster linear velocity than the linear velocity of transit of the base band and where the support conveyor has a low-friction surface, there is no opportunity for frictional resistance from the low-friction surface to the transit of the base band through the packaging apparatus, and thus the base band is not impeded from drawing the articles through the wrapping material applicator. The support conveyor may run faster than the second conveyor, i.e. so as to have a faster linear velocity than that of the second conveyor.

The intermediate support conveyor may be disposed within the applicator. The applicator may comprise an applicator ring having an axis of rotation substantially parallel to the downstream direction of transit of the articles such that the ring defines a hole through which, in use, articles are transported on the base band from the first to the second conveyor. The intermediate support conveyor may be provided adjacent to the hole defined by the applicator ring. The applicator ring may bear reels of wrapping material such that, in use, as articles pass through the aperture that the ring rotates around the articles dispensing wrapping material from the reels so as to helically wrap the articles. The reels of wrapping material may be located such that, in use, they are positioned radially outwardly of articles on a portion of the base band which is supported by the intermediate support conveyor.

In use, the support conveyor may be helically wrapped together with the collation of articles, the wrapping material around the support conveyor sliding off the support conveyor as the wrapped collation of articles leaves the support conveyor. In this case, the wrapped portion of the support conveyor advantageously has a cross-sectional area perpendicular to the direction of transit of the articles which is sufficiently small that the collation of articles remains wrapped together after leaving the support conveyor. It will be appreciated that the larger the cross-sectional area of the intermediate support conveyor, the more likely it is to result in loose wrapping once the support conveyor is removed from the wrapped articles, causing the collation of articles to fall apart.

The support conveyor may have a profile which is thinner than 20 mm and preferably thinner than 15 mm. The support conveyor may have a thinner profile than the upstream conveyor. The support conveyor may be narrower than the upstream conveyor. The support conveyor may be configured, in use, to be narrower than the dimensions of a collation of articles to be wrapped by the packaging apparatus. Reducing the size of the support conveyor results in a tighter wrapping after the articles have been wrapped and leave the support conveyor. The profile of the support conveyor may taper towards the downstream end of the support conveyor so that the wrapping material wrapped around the support conveyor slides off it more easily.

The support conveyor may comprise a conveyor belt trained around a relatively large diameter drive shaft and one or more relatively small diameter idler shafts. A relatively large diameter drive shaft would be required so as to provide a sufficient contact area between the drive shaft and the conveyor belt. The small diameter idler shafts may therefore be used to define first and second portions of the support conveyor such that the first portion has a relatively thick cross-section and comprises the drive shaft, and the second portion has a relatively thin cross-section and, in use, includes the wrapped portion of the support conveyor. The second portion may taper towards its downstream end. This is advantageous in that the wrapping material slides off the second portion of the support conveyor more easily. The first and second portions may be arranged in an inverted L shape, such that the first portion defines the vertical portion of the L shape and the second portion defines the horizontal portion of the L shape, the drive roller being provided at the bottom of the vertical portion of the support conveyor. The horizontal portion at least may be tapered inwardly in the direction of conveying such that its depth reduces in that direction. This profile allows the wrapping material to slide of the conveyor easily.

The base band applicator may further comprise a tensioning mechanism which, in use, tensions a portion of the base band while a collation of articles is placed upon the portion of the base band. The combination of tensioning the base band and providing a support conveyor provides an especially tight and accurate wrapping by ensuring both that there is no folded, or loose, base band material (or "slack") under articles being wrapped and that the base band material is not stretched by excessive drag on the base band.

The tensioning mechanism may comprise a tensioning roller over which the base band is fed. The base band applicator may further comprise a base band reel from which the base band is supplied, the tensioning roller being connected to the base band reel via a reverse transmission mechanism so as to be urged to rotate in an opposite direction to the direction of rotation of the base band reel; and wherein, in use, the base band is fed over the tensioning roller in the same rotational direction as the base band reel. The reverse transmission mechanism may be in the form of a resilient belt which is trained in a first direction around the base band reel and in an opposite direction around the tensioning roller.

The packaging apparatus may comprise an idler roller immediately adjacent to the downstream end of the first conveyor, the base band being fed over the idler roller and downstream through the packaging apparatus such that the portion of the base band under tension combines with the first conveyor to provide a substantially continuous support surface, over which, in use, collations of articles are carried. This is advantageous because a substantially continuous support surface reduces the likelihood that articles in the collation of articles will fall over during packaging. The provision of the base band is particularly advantageous in that, once placed on the base band, the articles are subsequently supported by the baseband, which moves relative to the apparatus together with the articles. Accordingly, subsequent movement of the articles is more reliable because they are being supported, and held fixed relative to one another, by the base band throughout.

The apparatus may be configured such that the unwrapped collations of articles are drawn into the applicator by the base band as a result of movement of the wrapped collations of articles on the second conveyor. This is advantageous in that it provides a simple solution to the problem of conveying the articles into the applicator at a reliable speed and spacing and no driving force need be applied to the base band by the intermediate support conveyor in order to drive the base band downstream.

The packaging apparatus is configured such that, in use, the wrapping material helically wrapped around the collation of articles and the base band comprise the same material. This is advantageous in that all of the material used to package the articles may easily be recycled, as the various components need not be separated from one another in order to be recycled. The material may be a film, such as a thin film. The material may comprise a plastics material. The wrapping material is typically in the region of 7 to 9 microns thick.

The applicator may comprise a rotary ring configured to support rolls of wrapping material, the support conveyor being provided so as to support the articles as they pass through the ring and are helically wrapped in the wrapping material.

According to a second aspect of the present invention, there is provided a packaging apparatus comprising a wrapping material applicator for helically wrapping together a collation of articles; a first conveyor for transporting unwrapped collations of articles to the applicator; a second conveyor for transporting wrapped collations of articles away from the applicator; a base band applicator upstream of the wrapping material applicator for providing a base band of wrapping material underneath the unwrapped collations of articles such that the base band extends between wrapped collations of articles downstream of the applicator and unwrapped collations of articles upstream of the applicator, the base band being wrapped together with the collations of articles; and a tensioning mechanism configured, in use, to place at least a portion of the base band under tension before an unwrapped collation of articles is placed onto that portion of the base band.

Providing a base band of wrapping material under the collation of articles, which band is then drawn into the helical wrapping material applicator and wrapped together with the collations of articles, is advantageous in that for at least a portion of the wrapping process the force required to draw the articles through the apparatus is provided to the articles via the base band itself. This provides a solution to the problem of how to drive articles through the apparatus where there is a gap between the first and second conveyors for accommodating the wrapping material applicator and allows for more reliable timing and spacing of collations passing through the helical wrapping material applicator.

Advantageously, tensioning the base band reduces the likelihood of collations of articles separating while being wrapped, ensuring that the wrapping is tighter. This has clear advantages in that wrapped collations are less likely to fall apart and do not need as much (if any) supporting or securing material.

The tensioning mechanism may be used in combination with the first aspect of the invention.

According to a third aspect of the present invention there is provided a method for helically wrapping together a collation of articles, the method comprising: conveying unwrapped collations of articles towards a wrapping applicator with a first conveyor; helically wrapping the collations of articles with a wrapping material by operating the wrapping applicator; conveying wrapped collations of articles away from the applicator with a second conveyor; wherein said conveying the unwrapped collations of articles comprises applying a base band of wrapping material underneath the unwrapped collations of articles such that the base band extends between wrapped collations of articles downstream of the applicator and unwrapped collations of articles upstream of the applicator, the base band being helically wrapped together with the collations of articles; and conveying the unwrapped collation of articles on the base band between the first and second conveyors on an intermediate support conveyor.

The intermediate support conveyor may be operated at a speed that is greater than that of the second and/or the first conveyor such that it provides no significant resistance to the passage of articles through the packaging apparatus. It will be appreciated that running the intermediate support conveyor at a speed that is greater than that of the other conveyors will not cause the articles to be drawn into the wrapping material applicator on the base band at a speed which is greater than the speed of the other conveyors. Indeed, if the friction between the intermediate support conveyor is desirably low then the intermediate support conveyor will provide no significant driving force to the base band at all.

The unwrapped collations of articles may be drawn into the applicator by the base band as a result of movement of the wrapped collations of articles on the second conveyor.

According to a fourth aspect of the present invention there is provided a method of wrapping collations of articles comprising providing a base band, a portion of which has been helically wrapped together with a collection of articles, and upon a further portion of which a further collation of articles is to be placed; tensioning the further portion of the base band; placing the further collation of articles upon the tensioned further portion of the base band such that the base band extends between the collation of articles and the further collation of articles; helically wrapping material around both the further collation of articles and the tensioned further portion of the base band The fourth aspect may be provided in combination with the third aspect of the invention.

The method may further comprise stretching the base band before placing the collation of articles upon the base band. The base band may be supported by a support conveyor during wrapping and by a downstream conveyor after wrapping, in which case the method may further comprise running the support conveyor faster than the downstream conveyor in one embodiment, the invention provides {text}.

BRIEF DESCRIPTION OF THE DRAWINGS

Specific embodiments of the present invention will now be described, by way of example only, with reference to the accompanying drawings in which.

DETAILED DESCRIPTION

Figure 1:
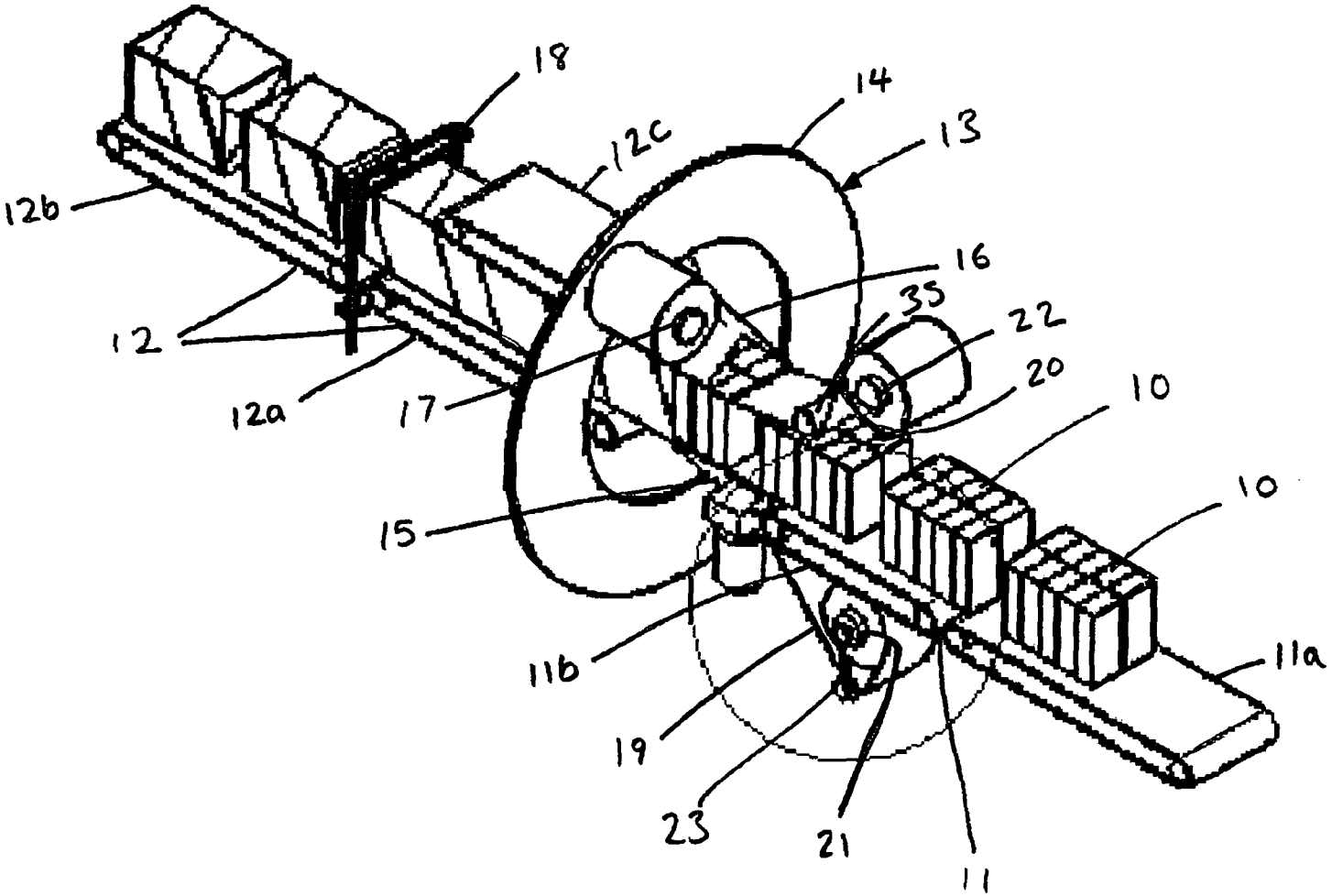
FIG. 1 is a perspective view of a wrapping machine in accordance with an aspect of the present invention.

Referring now to FIG. 1, collations of articles 10 to be wrapped are transported from an upstream conveyor 11 to a downstream conveyor 12 via a wrapping material applicator 13 that incorporates a rotary applicator ring 14. The upstream and downstream conveyors 11, 12 are spaced apart and the applicator 13 is disposed in the gap between them, the applicator is traversed by a support conveyor 15 that supports collations of articles 10 as they pass through the applicator 13. The applicator ring 14 rotates continuously about an axis that is substantially parallel to the longitudinal axes of the conveyors 11, 12 and dispenses wrapping material 16 from reels 17 disposed at angular intervals around a front face of the ring 14. The reels 17 are attached to collations of articles 10 arriving on the downstream conveyor 12 by streams of wrapping material 16 which have just been wrapped around the collations of articles. Thus, as the applicator ring 14 rotates around a further collation of articles 10 on the support conveyor 15, wrapping material 16 is pulled off the reels 17 and wrapped around the further collation of articles 10.

The wrapping material 16 on each reel 17 is in the form of a continuous elongate web of thin, stretchable synthetic plastics film such as a polyurethane based material. As the collations of articles 10 pass through the ring 14 over the support conveyor 15, the wrapping material 16 is stretched and then wrapped in a helical fashion around the articles 10 and the support conveyor 15. As the articles 10 move off the downstream end of the support conveyor 15, the wrapping material 16 wrapped around the articles 10 slips off the end of the support conveyor 15. The wrapping process continues as the articles progress along the conveyor such that the material 16 continues to be wound in a helical fashion around further articles 10 (and the spaces between the articles 10) so as to produce a continuous wrap of articles 10. The film 16 is designed to recover from the stretching so that it shrinks tightly around the articles 10 after wrapping.

The upstream and downstream conveyors 11, 12 both comprise two adjacent sections 11*a*, 11*b*, 12*a*, 12*b*. The downstream conveyor 12 further comprises an upper conveyor 12*c* which overlies the path of the wrapped articles 10, and which serves to prevent tilting of the wrapped articles 10 on the downstream conveyor 12 (due to a rolling force applied by applicator ring 14 via the wrapping material 16 wound around the articles). A cutting station 18 is interposed between adjacent sections 12*a*, 12*b* of the downstream conveyor 12. Here the individual collations of articles 10 are separated by cutting through the film 16 in the space between adjacent collations 10.

The sections 11*a*, 11*b* of the upstream conveyor 11 are arranged such that the first section 11*a* is upstream of the second section 11*b*, which is itself upstream of the support conveyor 15 of the wrapping material applicator 13. Further bands of wrapping material 19, 20 are drawn from a pair of reels 21, 22 disposed respectively below and above the second section of the upstream conveyor 11*b*.

A lower one of the further bands 19 is unwound from a reel 21 under the second section of the upstream conveyor 11*b*, passes through a tensioning mechanism 23 and emerges between the second section 11*b* and the support conveyor 15. The lower band 19 is then transported between the support conveyor 15 and the collations of articles 10 towards the downstream conveyor 12, the lower band 19 being wrapped together with the collations of articles as they progress downstream. This lower band 19 serves to facilitate the transfer of each collation of articles 10 through the wrapping material applicator 13 from the upstream to the downstream conveyors 11,12 by providing a continuously running surface that moves with the conveyors whilst carrying the articles 10. Thus, the lower band 19 serves to carry the articles 10 through the wrapping material applicator 13. It will be appreciated that the lower band 19 extends as an unbroken web supporting the articles 10 from the tensioning mechanism 23 onto the downstream conveyor 12. Thus, the lower band 19 also serves to maintain each collation 10 together during transfer so that when the collation 10 is wrapped it is tightly held together by the wrapping material 16. It will be appreciated that the lower band 19 may be introduced under the collations of articles 10 at a point further upstream, for example at the start of the upstream conveyor 11 or between the two sections of the upstream conveyor 11*a*, 11*b*.

Figure 2:
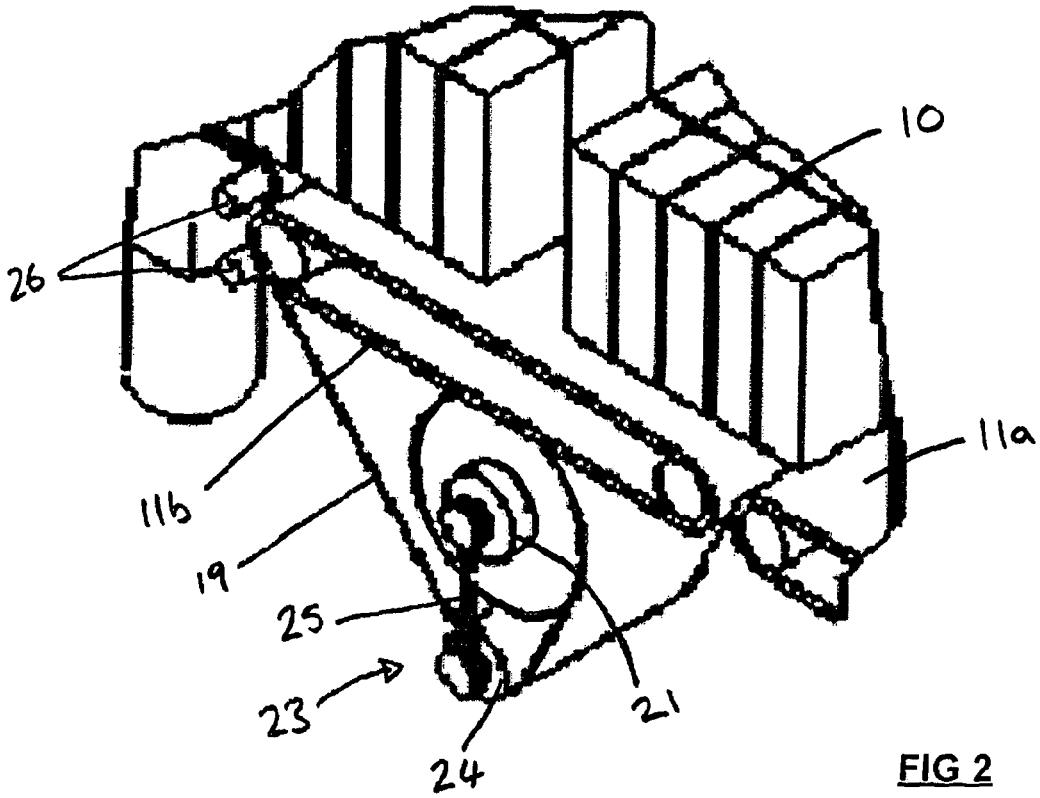
FIG. 2 is a close-up perspective view of a portion of the wrapping machine which is encircled in FIG. 1.

Referring now to FIG. 2, the tensioning mechanism 23 comprises a tensioning roller 24 which is provided in a spaced configuration from the reel 21. A belt 25, which preferably comprises a resilient or elastomeric material such as rubber and is formed in a continuous loop, is trained around a portion of the reel 21 in a forward direction and around a portion of the tensioning roller 24 in a reverse direction so as to follow a figure eight pattern. The belt 25 frictionally engages both the reel 21 and the tensioning roller 25 such that when the reel 21 turns a frictional force is applied to the tensioning roller 24 by the belt 25 so as to resist the tendency of the roller 24 to turn in the same direction as the reel 21.

Figure 3:
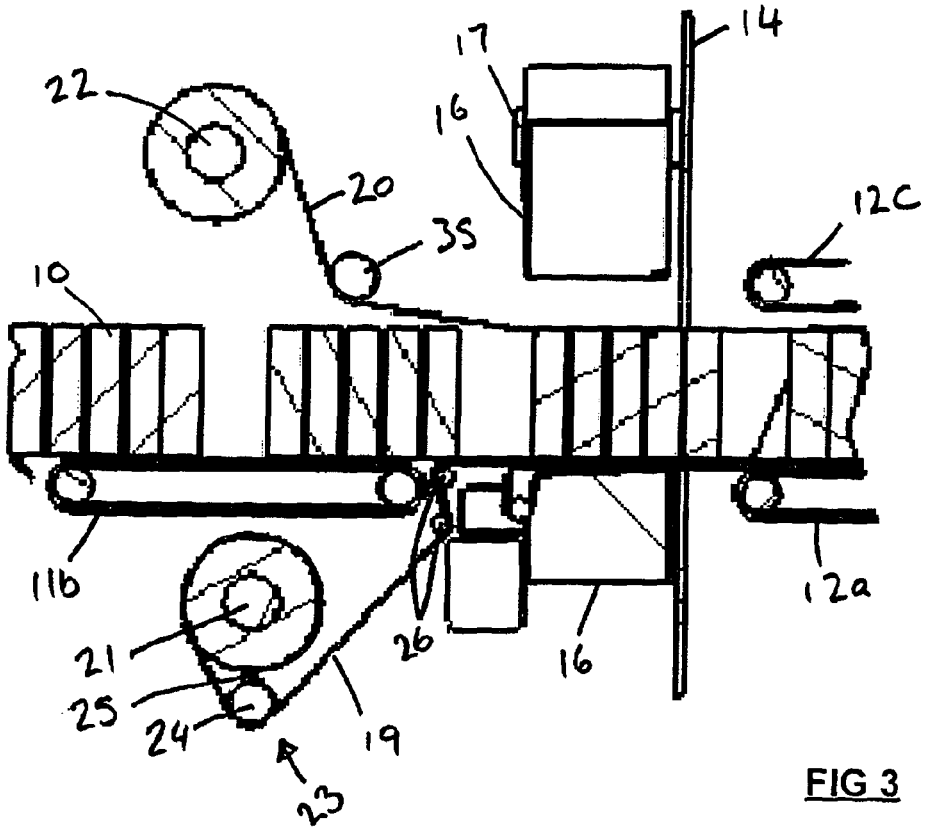
FIG. 3 is a side elevation of the portion of the wrapping machine shown in FIG. 2 shown from the other side.

The lower band 19 of wrapping material is fed from the reel 21 around the tensioning roller 24 (in a forward direction), through a pair of idler rollers 26 (immediately adjacent to the downstream end of the second section of the upstream conveyor 11*b*) and into the path of the collations of articles 10 leaving the second section of the upstream conveyor 11*b*, as can be seen in FIGS. 2 and 3. The lower band 19 then supports the articles 10, carrying them over to the support conveyor 15 where it is wrapped together with the articles 10 by the rotary ring 14. The portion of the lower band 19 which has been wrapped together with articles 10 is drawn onto the downstream conveyor 12 together with the wrapped articles 10, thus drawing a further portion of the lower band 19 carrying a further collation of articles 10 (upstream of the wrapping material applicator 13) towards the applicator 13. As wrapping material 19 is drawn from the reel 21 it peels away from the underlying material on the reel 21 and then passes around the tensioning roller 24. This causes both the reel and the tensioning roller 24 to rotate in the same direction. The belt 25, being fed in opposing directions around the reel 21 and the tensioning roller 24, cannot follow the movement of both the reel 21 and the roller 24 as they rotate in the same direction and thus drags against one of them. The dragging force of the belt 25 on the reel 21 or the tensioning roller 24 creates a braking force which is transferred to the lower band via the reel 21 and provides resistance to it being dispensed from the reel, thus creating tension in the lower band 19. The lower band 19 is therefore under tension as it is drawn from the reel 21, around the tensioning roller 24 and the idler rollers 26 and onto the support conveyor 15 under the articles 10. In practice there will be a degree of slip between the roller or the reel and the belt. It will be appreciated that the tensioning roller 24 and/or the band 25 may be replaced by any suitable mechanism by which the lower band 19 is placed under tension before articles 10 are placed onto it. It will further be appreciated that, in addition to tensioning the lower band 19, any appropriate tensioning mechanism may be configured to provide some stretching to the lower band 19 before articles are placed onto it.

The idler rollers 26 and the upstream conveyor 11*b* are positioned close together, which means that the portion of the lower band 19 which extends between the idler rollers 26 and the support conveyor 15 provides a substantially rigid and uniform supporting surface for the collations of articles 10 in line with the upstream conveyor 11*b*. Accordingly, articles 10 rolling off the upstream conveyor 11*b* and onto the lower band 19 have a relatively smooth transition and are less likely to fall over. Once the articles 10 have been placed on the lower band 19, they are carried by the lower band towards the wrapping material applicator 13. The lower band 19 is drawn downstream by the conveyor 12 and by connection to the portion of the lower band 19 which has already been wrapped together with collations of articles 10 sitting on the downstream conveyor 12. Thus, the lower band 19 draws the unwrapped collations of articles 10 sitting on the lower band 19 downstream into the wrapping material applicator 13.

The articles 10 in each collation are substantially prevented from sliding about on the surface of the lower band 19 due to frictional engagement with the lower band 19 (the lower band 19 and the articles 10 may even be arranged so as to adhere to one another in order to enhance this effect). However, slack in the band 19 (or the tendency of the band to stretch) would allow articles in the collation 10 to shift relative to one another without sliding on the band 19. The tensioning mechanism 23 therefore also serves to ensure that there is no slack in the band 19 (i.e. that the band 19 is under tension) and that the band 19 does not substantially stretch when a collation of articles 10 is placed on the lower band 19. It will further be appreciated that, should the lower band 19 deform under the weight of the articles 10 so that the collation of articles 10 rests on a bowed rather than a flat surface (such as would occur if the band 19 was not under tension or stretched under the weight of the articles 10), the articles 10 in each collation would bear upon one another and may even overcome the friction with the lower band 19 such that they slide apart from one another. Maintaining the lower band 19 under tension thus substantially prevents many forms of movement of the articles in a collation 10 relative to one another and maintains the articles in the collation 10 together. It will be appreciated that it is specifically the portion of the lower band 19 upon which articles 10 in a collation are being placed which must be under tension in order to prevent gaps between articles 10 in a collation; portions of the lower band 19 between collations of articles 10 need not be under tension unless gaps between collations of articles 10 are undesirable.

Figure 4:
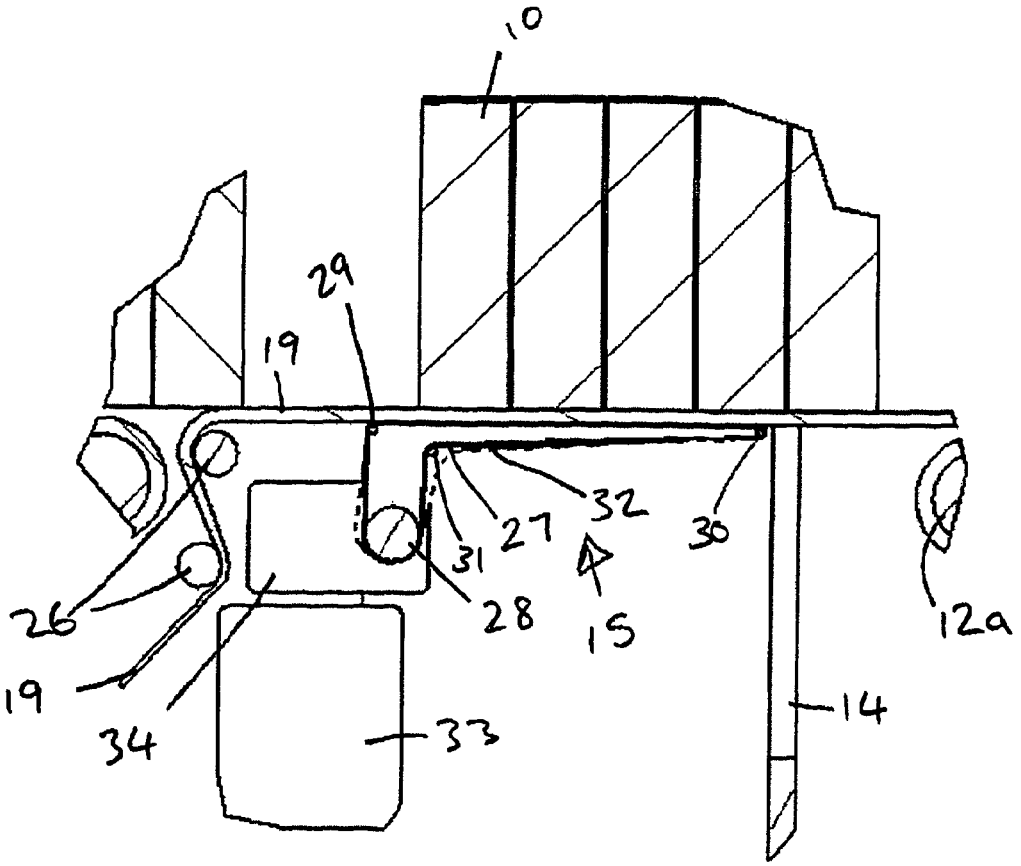
FIG. 4 is a close-up side elevation of the support conveyor portion of FIG. 3.

The support conveyor 15 is provided adjacent to the applicator ring 14 such that, in use, the reels 17 of wrapping material 16 are positioned radially of a collation of articles sitting on the support conveyor 15. The support conveyor 15 is downstream of (and in line with) the second section of the upstream conveyor 11*b* such that the idler rollers 26 are positioned between the upstream end of the support conveyor 15 and the downstream end of the upstream conveyor 11*b*. The support conveyor 15 comprises a conveyor belt 27 (shown in FIG. 4 and as a dotted line in FIG. 5) trained around a relatively large diameter drive roller 28, a small diameter upstream end roller 29, a small diameter downstream end roller 30 and a small diameter guide roller 31. The drive roller 28 drives the conveyor belt 27 and is provided directly beneath the upstream end roller 29. The end rollers 29, 30 define the upstream and downstream extent of the conveyor belt 27. The guide roller 31 is provided beneath the end rollers 29, 30 and adjacent to the upstream end of the support conveyor 15. The conveyor belt 27 has an inverted L-shaped profile with a horizontal portion that is tapered in depth in the direction of conveyance. The drive roller 28 or the guide roller 31 may be adjusted so as to adjust the tracking of the belt without affecting the shape of the conveyor belt as it passes between the end rollers 29, 30. In some embodiments, the support conveyor may include automatic tracking mechanics (which are known in the art) so as to automatically adjust the tracking of the belt while in operation.

The rollers 28,29,30,31 are rotatably mounted between a pair of side plates 32. The side plates 32 (one of which is shown in dashed lines in FIG. 4) substantially share the inverted L shape of the conveyor belt, but have a slightly larger profile than the belt 27. Thus, during wrapping the side plates 32 function both to support the rollers and to hold wrapping material 16 away from the under side of the conveyor belt 27. The side plates 32 (and the inverted L-shape of conveyor belt 27) also exhibit a taper as they extend downstream such that the horizontal portion of the support conveyor 15 is thinner at its downstream end than its upstream end. A motor 33 is connected to the drive roller 28 via a gear box 34, an output shaft of which (not shown) drives the drive roller 28.

Figure 5:
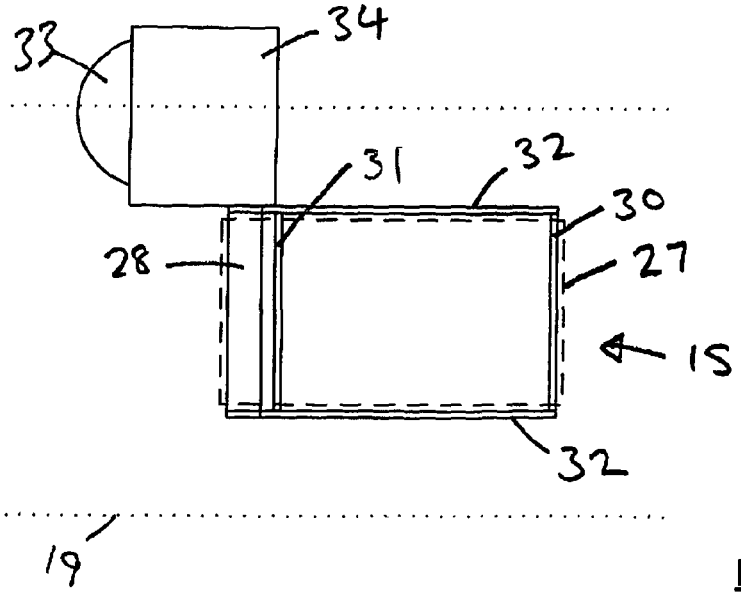
FIG. 5 is a plan view of the support conveyor of FIG. 4 shown is isolation.

The configuration is advantageous in that the large diameter drive roller 28 provides a more reliable and powerful driving force to the conveyor belt 27 than would be achieved with a small diameter drive roller. However, during wrapping as described in detail below a portion of the support conveyor 15 is briefly wrapped together with each collation of articles 10, before sliding out of the wrapping as the articles 10 move on to the downstream conveyor 12*a*. A large diameter drive roller in a conventional conveyor belt would result in a large profile for the conveyor itself, which is undesirable because when the support conveyor 15 slides out of a wrapped collation of articles the wrapping material 16 would not be tightly wound around the collation. Thus, the inverted L shaped configuration of the present conveyor belt is particularly advantageous for use as a support conveyor in a helical wrapping apparatus because it reduces the cross-sectional area (in the plane perpendicular to the direction of transit of the articles 10) of the conveyor 15, and therefore the amount of slack left in the wrapped collation of articles 10. The taper defined by the conveyor belt 27 and the side plates 32 also provides an advantage in that the wrapping material 16 slides off the conveyor 15 more easily. Given that the helical wrapping material is pre-stretched, the relatively small amount of slack remaining in the wrapping is taken up by a contraction of the wrapping material after wrapping. As shown in FIG. 5, the support conveyor 15 is also substantially narrower than the width of the lower band of wrapping material 19 (indicated by the dotted line) and hence the width of a collation of articles 10. This also serves to reduce the cross-sectional area of the support conveyor 15.

As described above, the lower band 19 is drawn downstream so as to draw articles 10, which have been placed on the lower band 19, through the wrapping material applicator 13. The purpose of the support conveyor 15 therefore is to help the lower band 19 to bear the weight of the articles 10 whilst those articles 10 are being helically wrapped by the applicator ring 14. It will be appreciated that a means of supporting the lower band 19 which also provided some frictional resistance to movement of the lower band 19 or the articles 10 downstream may stretch and/or break the lower band 19 resulting in the articles not reliably travelling downstream of the wrapping material applicator 13. Thus, providing an intermediate support such as the support conveyor 15 is advantageous in that the surface of the conveyor 15 in contact with the lower band 19 can move together with the lower band 19 which reduces friction. However, the movement of the support conveyor 15 does not need to drive the articles 10 or the lower band 19 downstream because the lower band 19 moves downstream as a result of being wrapped together with articles being drawn downstream by the downstream conveyor 12.

The upper band of wrapping material 20 is dispensed from the reel 22 and around an upper idler roller 35 disposed above the upstream conveyor 11. The upper band 20 overlies a top surface of the collations of articles 10. Both the upper and lower bands 20, 19 may move in adhesion with the articles and may be of the same or similar material to that of the main wrapping material film 16. It will be appreciated that as a particular collation of articles 10 is wrapped by the applicator 13, the helical bands 16 also wrap around the upper and lower bands 20, 19 and in the process turn up or down around the collation 10 any exposed side edges of the bands. The completed wrapped collation 10 will thus have an external helical wrap containing both the collation of articles 10 and the sheets of the upper and lower bands 20, 19 of wrapping material.

In operation, a collation of articles 10 is placed together, in a close configuration, onto the upstream conveyor 11 and is conveyed downstream towards the support conveyor 15. As the articles leave the upstream conveyor 11, they pass over one of the idler rollers 26 (over which the lower band 19 runs) and under the upper idler roller 35 so that the collation has the lower band 19 beneath it and the upper band 20 above it. The articles 10 are supported by the lower band 19 over a short distance between the upstream conveyor 11 and the support conveyor 15. As the lower band 19 carrying the collation of articles 10 passes onto the support conveyor 15, the collation of articles is wrapped together with the upper and lower bands (and temporarily with the support conveyor 15) by the applicator reel 14. The support conveyor 15, running faster than the transit speed of the articles 10 from the upstream conveyor 11 to the downstream conveyor 12, provides no significant frictional resistance to the transit of the articles 10. While being helically wrapped, the articles 10 are drawn from the support conveyor 15 and onto the downstream conveyor 12 by the lower band 19. At this point, it will be apparent that a support conveyor having a small cross-sectional area (perpendicular to the direction of transit of the articles) is advantageous in that, when it is removed from the wrapped collation of articles, less elastic contraction is required in the wrapping material to take up the slack which has been created by the removal of the support conveyor. The wrapped train of articles then passes the cutter station 18 where the helical wrapping film 16 is severed to leave individual packs of wrapped articles. The cutter station 18 comprises a frame 44 on which there is supported a heated horizontal wire that is moved in a vertical direction to heat and sever the wrapping material 16. The wrapping film naturally shrinks around the articles to provide for a self-contained wrapped package. It will of course be appreciated that any desirable method of separating the collations of articles from one another may be used.

The wrapping film is typically in the region of 7 to 9 microns thick

The invention has many advantages compared to existing designs. In particular, the action of the band 25 on the tensioning roller 24, the reel 21 and the lower band 19 reduces the likelihood of loosely wrapped collations of articles 10. Furthermore, the provision of a support conveyor 15 further reduces the likelihood of loosely wrapped articles by both reducing the span over which the lower band 19 must support the weight of articles 10 and by providing as little resistance as possible so as to prevent stretching of the lower band prior to wrapping.

The invention provides for a packaging method that ensures that there is no significant waste wrapping material. In the event that the upper and lower bands 19,20 and the helical wrapping material 16 are all made of the same material the invention makes the process of recycling used packaging easier.

It has been established in tests that for a pack of 350 mm by 350 mm in section, 3 reels, 40 rpm rotary ring speed, 20% overlap in wrap and downstream conveyor running at 12 m per minute can achieve around 35 ppm.

The apparatus has a relatively small size compared to existing designs.

It is to be appreciated that the upper film band 20 is not essential and is generally only to be used where the article have sharp edges or other protrusions that have a tendency to pierce the helical wrapping film. In the event that the upper film band 20 moves in adhesion with the articles, each collation of articles is drawn through the wrapping material applicator by both the upper and lower bands 19, 20. This provides the advantage of increased stability in each collation before helical wrapping occurs.

The present invention has the advantage that there is no need to alter parts of the machine set-up for different size and shapes of articles. The same film width can be used irrespective of the pack size. Generally prior art machines use a different width film for different width products.

The apparatus is designed to use thin pre-stretched film which may have folded edges to give strapping resistance to the pack. The helical wrapping film obviates the need for other packaging elements such as boxes, trays etc On all of the conveyors except the support conveyor 15, the texture of the belts is designed to optimise the friction between the articles (or the upper/lower bands) and the belt surface. The belt 27 of the support conveyor 15 is configured so as to minimise friction between the belt 27 and the lower band of wrapping material 19.

It is to be appreciated that the wrapping apparatus may have applications outside of packaging of articles with synthetic plastics film. For example, the same invention could be used to wrap any elongate flexible material such as a textile, fibres, strips of material, metal composite bands or the like to an article to create any sort of structural component.

The tensioning mechanism 23 may readily be replaced by a braking mechanism applied to the lower band reel 21. Alternatively, the tensioning reel 24 of the above embodiment may be retained and the band 25 replaced by a friction clutch applied to the tensioning reel. In general terms, it will be appreciated that the tensioning mechanism may be replaced by any appropriate torque inducing mechanism or friction inducing mechanism so as to achieve the desired effect upon the lower band 19.

What is claimed is:

1. A packaging apparatus comprising:

a wrapping material applicator for helically wrapping together a collation of articles, a first conveyor for transporting unwrapped collations of articles to the applicator;

a second conveyor for transporting wrapped collations of articles away from the applicator;

a base band applicator upstream of the wrapping material applicator for providing a base band of wrapping material underneath an unwrapped collation of articles so as to be wrapped together with the unwrapped collation of articles, such that the base band extends between wrapped collations of articles downstream of the applicator and unwrapped collations of articles upstream of the applicator; and a tensioning mechanism configured, in use, to place at least a portion of the base band under tension before an unwrapped collation of articles is placed onto that portion of the base band, wherein the packaging apparatus comprises an idler roller immediately adjacent to the downstream end of the first conveyor and a support conveyer, the base band being fed over the idler roller and onto the support conveyor so as to provide a substantially continuous support surface between the first conveyor and the support conveyor, over which, in use, collations of articles are carried.

2. The packaging apparatus of claim 1 wherein the tensioning mechanism comprises a tensioning roller over which the base band is fed.

3. The packaging apparatus of claim 2, wherein the base band applicator further comprises a base band reel from which the base band is supplied, the tensioning roller being connected to the base band reel via a reverse transmission mechanism so as to be urged to rotate in an opposite direction to the direction of rotation of the base band reel; and wherein, in use, the base band is fed over the tensioning roller in the same rotational direction as the base band reel.

4. The packaging apparatus of claim 1, wherein the packaging apparatus is configured such that the unwrapped collations of articles are drawn into the applicator by the base band as a result of movement of the wrapped collations of articles on the second conveyor.

5. A method of wrapping collations of articles comprising:

providing a base band, a portion of which has been helically wrapped together with a collation of articles, and upon a further portion of which a further collation of articles is to be placed;

tensioning the further portion of the base band; placing the further collation of articles upon the tensioned further portion of the base band such that the base band extends between the collation of articles and the further collation of articles; and helically wrapping material around both the further collation of articles and the tensioned further portion of the base band, wherein the base band is supported by a support conveyor during wrapping and by a downstream conveyor after wrapping, the method further comprising running the support conveyor faster than the downstream conveyor.

6. The method of claim 5, further comprising stretching the further portion of the base band before placing the further collation of articles upon the base band.

7. The method of claim 5, wherein the helical wrapping is performed by a wrapping material applicator and the further collation of articles is drawn into the applicator by the base band as a result of movement of the collation of articles on the downstream conveyor.

8. A packaging apparatus comprising:

a wrapping material applicator for helically wrapping together a collation of articles, a first conveyor for transporting unwrapped collations of articles towards the applicator;

a second conveyor for transporting wrapped collations of articles away from the applicator; and a base band applicator upstream of the wrapping material applicator for providing a base band of wrapping material underneath the unwrapped collations of articles such that the base band extends between wrapped collations of articles downstream of the applicator and unwrapped collations of articles upstream of the applicator, the base band being wrapped together with the collations of articles, wherein the first and second conveyors are spaced apart and, the applicator is provided between them, and the packaging apparatus further comprises an intermediate support conveyor between the first and second conveyors configured, in use, to support the base band within the applicator, wherein the support conveyor is configured to run at least as fast as the speed of transit of the base band through the applicator.

9. The packaging apparatus of claim 8, wherein the support conveyor offers substantially no resistance to the transit of the base band through the packaging apparatus.

10. The packaging apparatus of claim 8, wherein the intermediate support conveyor has a movable surface for contact with the base band having a lower coefficient of friction than a corresponding surface on either the first or second conveyor.

11. The packaging apparatus of claim 10, wherein the reduced coefficient is, at least in part, the result of a friction reduction coating applied to the movable surface.

12. The packaging apparatus of claim 11, wherein the support conveyor is configured to run faster than the second conveyor.

13. The packaging apparatus of claim 8, wherein the support conveyor is configured to run faster than the speed of transit of the base band through the applicator.

14. The packaging apparatus of claim 8, wherein the intermediate support conveyor is disposed within the applicator.

15. The packaging apparatus of claim 14, wherein the applicator comprises an applicator ring having a rotational axis substantially parallel to the downstream direction such that the ring defines an aperture through which, in use, articles are transported from the first to the second conveyor.

16. The packaging apparatus of claim 15, wherein the intermediate support conveyor is provided in the aperture.

17. The packaging apparatus of claim 16, wherein the applicator ring supports at least one reel of wrapping material such that, in use, as articles pass through the aperture the ring rotates around the articles dispensing wrapping material from the at least one reel so as to helically wrap the articles.

18. The packaging apparatus of claim 17, wherein the at least one reel of wrapping material is located such that, in use, it is positioned radially outwardly of articles supported by the intermediate support conveyor.

19. The packaging apparatus of claim 8, wherein, in use, the intermediate support conveyor is helically wrapped together with the collation of articles, the wrapping material around the support conveyor sliding off the support conveyor as the wrapped collation of articles passes downstream, the wrapped portion of the support conveyor having a cross-sectional area perpendicular to the direction of transit of the articles which is sufficiently small that the collation of articles remains wrapped together after leaving the support conveyor.

20. The packaging apparatus of claim 8, wherein the support conveyor is narrower than the first conveyor.

21. The packaging apparatus of claim 8, wherein the intermediate support conveyor has a cross-sectional area perpendicular to the direction of transit of the articles that is less than that of the first and/or the second conveyor.

22. The packaging apparatus of claim 8, wherein the support conveyor is configured, in use, to be narrower than a collation of articles to be wrapped by the packaging apparatus.

23. The packaging apparatus of claim 8, wherein the base band applicator further comprises a tensioning mechanism which, in use, tensions a portion of the base band while a collation of articles is placed upon the portion of the base band.

24. The packaging apparatus of claim 23, wherein the tensioning mechanism comprises a tensioning roller over which the base band is fed.

25. The packaging apparatus of claim 24, wherein the base band applicator further comprises a base band reel from which the base band is supplied, the tensioning roller being connected to the base band reel via a reverse transmission mechanism so as to be urged to rotate in an opposite direction to the direction of rotation of the base band reel; and wherein, in use, the base band is fed over the tensioning roller in the same rotational direction as the base band reel.

26. The packaging apparatus of claim 23, wherein the packaging apparatus comprises an idler roller immediately adjacent to the downstream end of the first conveyor, the base band being fed over the idler roller and downstream through the packaging apparatus such that the portion of the base band under tension combines with the first conveyor to provide a substantially continuous support surface, over which, in use, collations of articles are carried.

27. The packaging apparatus of claim 8, wherein the packaging apparatus is configured such that, in use, the wrapping material helically wrapped around the collation of articles and the base band comprise the same material.

28. The packaging apparatus of claim 8, wherein the apparatus is configured such that the unwrapped collations of articles are drawn into the applicator by the base band as a result of movement of the wrapped collations of articles on the second conveyor.

29. A method for helically wrapping together a collation of articles, the method comprising: conveying unwrapped collations of articles towards a wrapping applicator with a first conveyor; helically wrapping the collations of articles with a wrapping material by operating the wrapping applicator; conveying wrapped collations of articles away from the applicator with a second conveyor; wherein said conveying the unwrapped collations of articles comprises applying a base band of wrapping material underneath the unwrapped collations of articles such that the base band extends between wrapped collations of articles downstream of the applicator and the unwrapped collations of articles upstream of the applicator, the base band subsequently being helically wrapped together with the collations of articles; and conveying the unwrapped collation of articles on the base band between the first and second conveyors on an intermediate support conveyor, wherein the intermediate support conveyor is operated at a speed greater than the first conveyor.

30. The packaging apparatus of claim 29, wherein the unwrapped collations of articles are drawn into the applicator by the base band as a result of movement of the wrapped collations of articles on the second conveyor.

31. A packaging apparatus comprising:

a wrapping material applicator for helically wrapping together a collation of articles, a first conveyor for transporting unwrapped collations of articles towards the applicator;

a second conveyor for transporting wrapped collations of articles away from the applicator;

a base band applicator upstream of the wrapping material applicator for providing a base band of wrapping material underneath the unwrapped collations of articles such that the base band extends between wrapped collations of articles downstream of the applicator and unwrapped collations of articles upstream of the applicator, the base band being wrapped together with the collations of articles, wherein the first and second conveyors are spaced apart and, the applicator is provided between them;

the packaging apparatus further comprises an intermediate support conveyor between the first and second conveyors configured, in use, to support the base band within the applicator;

the intermediate support conveyor has a movable surface for contact with the base band having a lower coefficient of friction than a corresponding surface on either the first or second conveyor;

the reduced coefficient is, at least in part, the result of a friction reduction coating applied to the movable surface, wherein the support conveyor is configured to run faster than the second conveyor.

32. A packaging apparatus comprising:

a wrapping material applicator for helically wrapping together a collation of articles, a first conveyor for transporting unwrapped collations of articles towards the applicator;

a second conveyor for transporting wrapped collations of articles away from the applicator; and a base band applicator upstream of the wrapping material applicator for providing a base band of wrapping material underneath the unwrapped collations of articles such that the base band extends between wrapped collations of articles downstream of the applicator and unwrapped collations of articles upstream of the applicator, the base band being wrapped together with the collations of articles, wherein the first and second conveyors are spaced apart and, the applicator is provided between them;

the packaging apparatus further comprises an intermediate support conveyor between the first and second conveyors configured, in use, to support the base band within the applicator;

the base band applicator further comprises a tensioning mechanism which, in use, tensions a portion of the base band while a collation of articles is placed upon the portion of the base band;

the packaging apparatus comprises an idler roller immediately adjacent to the downstream end of the first conveyor, the base band being fed over the idler roller and downstream through the packaging apparatus such that the portion of the base band under tension combines with the first conveyor to provide a substantially continuous support surface, over which, in use, collations of articles are carried.

* * * * *